United States Patent [19]

Hayamizu et al.

[11] Patent Number: 4,955,116

[45] Date of Patent: Sep. 11, 1990

[54] METHOD FOR PRODUCING TUBULAR NEEDLE PUNCHED FELT

[75] Inventors: Katsuyoshi Hayamizu, Moriyama; Masakatsu Nakajima, Kusatsu; Hiroyuki Ogawa, Kashiwa, all of Japan

[73] Assignee: Japan Vilene Company, Ltd., Tokyo, Japan

[21] Appl. No.: 403,422

[22] Filed: Sep. 6, 1989

[51] Int. Cl.[5] ..... D04H 1/46

[52] U.S. Cl. ..... 28/110

[58] Field of Search ..... 28/103, 108, 110, 140, 28/141, 142, 148, 158; 525/523; 548/335; 428/254

[56] References Cited

U.S. PATENT DOCUMENTS

| | | | |
|---|---|---|---|
| 1,452,704 | 4/1923 | Poulin | 28/141 X |
| 1,524,681 | 2/1925 | Badger | 28/142 X |
| 2,459,688 | 1/1949 | De Vyver | 28/142 X |
| 3,166,823 | 1/1965 | Bernard | 28/142 X |
| 4,071,394 | 1/1978 | Ball | 28/110 X |
| 4,138,772 | 2/1979 | Dilo | 28/110 |
| 4,430,380 | 2/1984 | Hönel | 428/254 |
| 4,762,585 | 8/1988 | Schneider | 525/523 X |
| 4,845,234 | 7/1989 | Schneider | 548/335 |

FOREIGN PATENT DOCUMENTS

| | | |
|---|---|---|
| 51-55469 | 5/1976 | Japan . |
| 58-33098 | 7/1983 | Japan . |
| 61-130029 | 6/1986 | Japan . |
| 2031107 | 4/1980 | United Kingdom . |

*Primary Examiner*—Werner H. Schroeder
*Assistant Examiner*—Ismael Izaguirre
*Attorney, Agent, or Firm*—Armstrong, Nikaido, Marmelstein, Kubovcik & Murray

[57] ABSTRACT

A method for producing a tubular needle punched felt, comprising the steps of: (a) overlapping not less than two long sheets comprising a web to form thin layer portions at both side edges of the overlapped sheets and a thick layer portion at the central portion of the overlapped sheets by dislocating the sheets in width direction; (b) needle punching one part or whole of the above central thick layer portion of the overlapped sheets to form a lapped sheet; (c) rolling the lapped sheet and transforming the lapped sheet into a tubular one and overlapping the above thin layer portions with each other; and (d) needle punching the above overlapped thin layer portions to make the thin layer portions one body. The tubular needle punched felt obtained in this invention can be suitably used as a tubular felt used in the INS method and the like.

3 Claims, 2 Drawing Sheets

METHOD FOR PRODUCING TUBULAR NEEDLE PUNCHED FELT

BACKGROUND OF THE INVENTION

The present invention relates to a method for producing a tubular needle punched felt, and more particularly to a method for producing a seamless tubular needle punched felt which can be suitably used as a needle punched felt for Insituform method (hereinafter referred to as "INS method"), and the like.

In these days, INS method has been developed as a technical method for repairing a pipe and the like buried under the ground, and attracts public attention.

The INS method is a very useful technique for repairing a pipe which is buried under the ground since the pipe can be completely repaired without digging up the pipe. The INS method comprises the steps of:

(a) using a tubular felt which is impregnated with a thermosetting resin, which is not yet cured, and of which outside surface is laminated with a film,
(b) fixing one edge of the reversed tubular felt with an inlet port of a pipe to be repaired,
(c) inserting the tubular felt into the pipe with accelerating the reversing of the tubular felt by pressing the outside surface of the tubular felt in the pipe with water, and
(d) curing the thermosetting resin impregnated in the tubular felt by heating the water in the pipe by means of a boiler and the like.

Conventionally, the technics described in Japanese Examined Patent Publication No. 33098/1983 has been employed for producing the tubular felt which is used in the INS method.

The method for producing a tubular felt described in Japanese Examined Patent Publication No. 33098/1983 is a method characterized in that:

(a) rolling a long web having a sheet form to give a tubular web,
(b) contacting both edges facing each other of the web so that the both edges form a butt-joint,
(c) stitching both edges so that a thread crosses the both edges, and
(d) laminating a ribbon for sealing on the stitched surface or coating the stitched surface with a resin to give a tubular felt.

However, the above method for producing a tubular felt has the following problems with regard to the product and producing steps.

When a thermosetting resin is impregnated into the obtained tubular felt, the butt-joint of the tubular felt is scarcely impregnated with the resin, so that foams are likely to generate in the butt-joint. Therefore, cracks are easy to generate on the surface of the resulting final product.

The above method has a very low productive efficiency since special seaming works are required in the producing steps and there are necessitated many complicated steps in the above method.

Further, the obtained tubular felt is easy to generate strain and gaps particularly at the butt-joint being outside of the tubular felt since there is a difference between the length of the inside circumference and that of the outside circumference of the tubular felt as the result of rolling the sheet having a certain thickness.

The object of the present invention is to solve the above-mentioned problems of the conventional tubular felts and to provide a method for producing a tubular needle punched felt which exhibits following preferable effects:

(a) the obtained tubular needle punched felt does not generate foams and cracks on the surface of the felt at the time of curing the resin impregnated in the felt since the needle punched felt is seamless and is uniformly impregnated with a resin,
(b) the method achieves the improvement of efficiency, labor saving and excellent profitability and removes conventional complexities entirely as well as it becomes easy to produce the product by means of this method since this method is free from working for seaming and sealing of the stitched surfaces in the producing steps,
(c) the method is free from changing the equipments owing to sizes of diameter of the desired tubular needle punched felt since the tubular needle punched felt having a desired size of the diameter can be obtained only by changing the size of the sheet, and
(d) efficiency of producing the tubular needle punched felt can be extremely improved since continuous production can be conducted in accordance with this method.

These and other objects of the present invention will become apparent from the description hereinafter.

SUMMARY OF THE INVENTION

In accordance with the present invention, there is provided a method for producing a tubular needle punched felt, comprising the steps of:

(a) overlapping not less than two long sheets comprising a web to form thin layer portions at both side edges of the overlapped sheets and a thick layer portion at the central portion of the overlapped sheets by dislocating the sheets in width direction;
(b) needle punching one part or whole of the above central thick layer portion of the overlapped sheets to form a lapped sheet;
(c) rolling the lapped sheet and transforming the lapped sheet into a tubular one and overlapping the above thin layer portions with each other; and
(d) needle punching the above overlapped thin layer portions to make the thin layer portions one body.

DETAILED DESCRIPTION

The present invention is explained with referring to figures in order of the producing steps.

Figure 1:
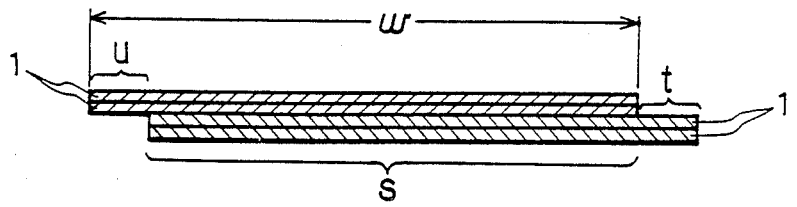
FIG. 1 is a schematic sectional view showing means to overlap the long sheets at the first step of the present invention.

FIG. 1 is a schematic sectional view of long sheets in the width direction, which shows means for overlapping the long sheets at the first step in the present invention.

As shown in FIG. 1, not less than two long sheets 1 are overlapped so that the sheets are dislocated in a direction of width of the sheets.

The long sheets 1 are webs having a sheet-like form produced by carding and the like or webs of which fibers are entangled temporarily by needle punching and the like. Examples of the long sheet are, for instance, a polyester web, of which area weight is 150 to 300 g/m$^2$, needle punched with adjusting needle density to 20 to 80 strokes/cm$^2$.

In FIG. 1, four long sheets in total are overlapped, wherein two long sheets are in the upper part and two long sheets are in the lower part, respectively. However, the present invention is not limited to the number of the overlapped sheets.

When the web being not temporarily entangled is used as the long sheet, it is preferable that the long sheets are entangled temporarily after overlapping the long sheets.

It is desirable that the width formed as the result of the dislocation of the long sheets (hereinafter referred to as "width of dislocation") in FIG. 1 is within a range of 5 to 20% of the width w of the long sheet 1. For example, when the width w of the long sheet 1 is 1000 mm, the width of dislocation is preferably about 50 to 200 mm, more preferably about 70 to 150 mm.

As the result of overlapping the long sheets 1 in this way, a central thick layer portion of the overlapped sheets in which all of the long sheets are overlapped (hereinafter referred to as "a central thick layer portion s") and thin layer portions located on both sides in the width direction of the overlapped sheets of which number of the overlapped sheets is fewer than that of the central thick layer portion (hereinafter referred to as "thin layer portions t and u"), are formed.

It is not necessary that the thicknesses of the thin layer portions t and u are equal. For example, the thin layer portion t can be a layer which is formed by overlapping three long sheets 1. To the contrary, the thin layer portion u can be a layer formed by overlapping two long sheets 1. In that case, the central thick layer portion s is formed by overlapping five long sheets 1.

That is to say, it is desirable that the thickness, which is formed by overlapping the thin layer portions t and u, is equal to the thickness of the central thick layer portion s.

Figure 2:
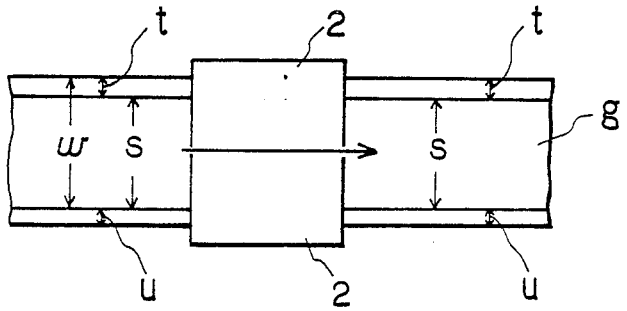
FIG. 2 is a schematic plan view showing the second step of the present invention.

FIG. 2 is a schematic plan view of the second step of the present invention. The central thick layer portion s is needle punched by means of a needle punching equipment 2 to lap all sheets as shown in FIG. 2. It is preferable that the needle density of needle punching in such cases is 100 to 200 strokes/cm$^2$. In that case, it is obvious that the central thick layer portion s is slightly shrunk in the width direction as the result of entangling of fibers in the long sheets.

As the result of the above procedures, a lapped sheet g which comprises the thin layer portions t and u can be obtained.

It is preferable that the whole surface of the central thick layer s is needle punched at the second step. However, the central thick layer s can be needle punched partly depending on purposes or uses of the obtained tubular needle punched felt.

The third step is a step characterized by rolling the lapped sheet g obtained in the second step into a tubular one and by overlapping the thin layer portions t and u.

The rolling can be carried out by means of proper means. It is preferable that when the rolling is conducted, for example, a guider having a slit portion, which guides to gradually roll the lapped sheet g, is used.

Figure 3:
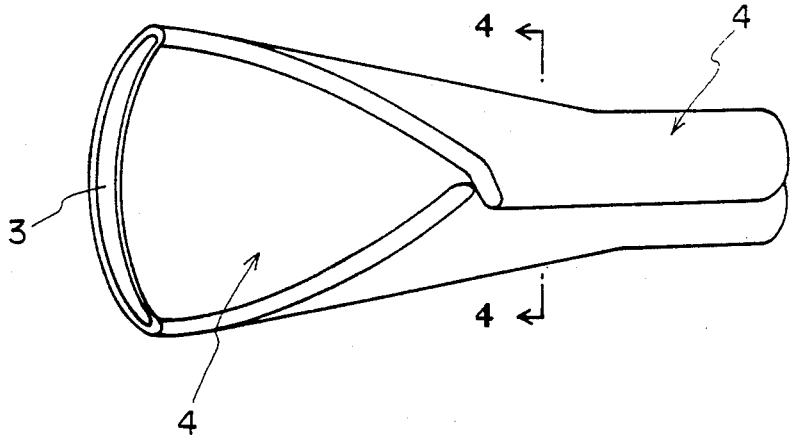
FIG. 3 is a schematic plan view showing a metal guider having a slit portion for guiding a lapped sheet (hereinafter referred to as "a guider having a slit portion") which is used at the third step of the present invention.
Figure 4:
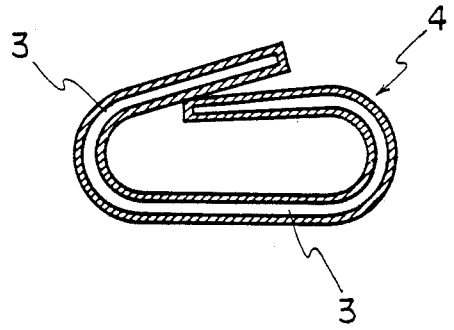
FIG. 4 is an enlarged sectional view on lines 4—4 in FIG. 3.

FIG. 3 is a schematic plan view showing a guider having a slit portion used at the third step. FIG. 4 is an enlarged sectional view on lines A—A in FIG. 3.

As shown in these figures, using the guider having a slit portion 4 of which approach is a slit 3 having nearly plane-shape, which is gradually transforming roundly into tubular one having a overlapped portion partly at its exit, the lapped sheet g transformed into tubular one can be produced and the thin layer portions t and u can be overlapped together by putting the lapped sheet g into the approach of the guider having a slit portion 4 and by taking it out from the exit of the guider 4.

Figure 5:
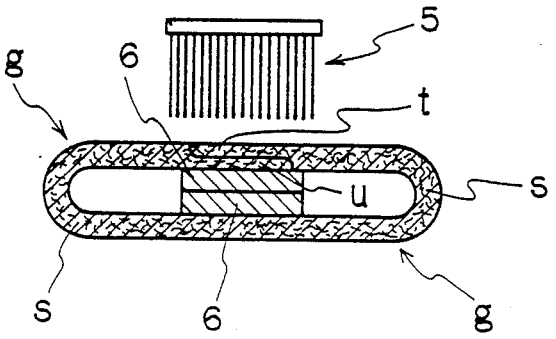
FIG. 5 is a schematic sectional view showing an example of the fourth step of the present invention.

FIG. 5 is a schematic longitudinal sectional view showing one example of the fourth step of the present invention.

As shown in FIG. 5, the portion of the lapped sheet g in which thin layer portions t and u are overlapped (hereinafter referred to as "an overlapped portion") is subjected to needle punching to make the thin layer portions one body. At that time, it is preferable that the overlapped portion is needle punched after inserting a supporting material 6 into the lapped sheet g transformed into tubular one, as shown in FIG. 5, since the thin layer portions t and u can be strongly entangled together owing to the effect of the supporting material 6.

This supporting material 6 has a function as a spacer. Preferable examples of the supporting material 6 are, for instance, a foamed non-woven fabric (available from JAPAN VILENE COMPANY, LTD. under the trade name "Particle mat") and other cushioning materials.

The supporting material 6 can be inserted into the lapped sheet g by wrapping the supporting material 6 into the lapped sheet g at the same time when the lapped sheet g is transformed into tubular one. It is preferable that one side portion and the other portion of the supporting material 6 are linked together by means of a string since the supporting material 6 is easily taken out from the lapped sheet when the supporting material 6 is required to be taken out.

It is preferable that the overlapped portion of the lapped sheet g is subjected to needle punching after pressing the lapped sheet to transform it into a flat one with positioning the overlapped portion under the needle as shown in FIG. 5, since the needle punching can be carried out with adjusting the needle depth correctly in a stable condition in that case.

It is preferable that a condition of needle punching at the fourth step is almost the same as that at the second step. For example, when the needle density is 150 strokes/cm$^2$ at the second step, it is preferable that the needle density at the fourth step is also 150 strokes/cm$^2$ since it is easy to give the tubular needle punched felt having average physical properties around entire circumference thereof.

The tubular needle punched felt obtained in this way is seamless since the tubular needle punched felt has no seams and is uniformly needle punched around entire circumference thereof.

The present invention is more specifically described and explained by means of the following Example. It is to be understood that the present invention is not limited to the Example, and various changes and modifications may be made in the invention without departing from spirit and scope thereof.

EXAMPLE

A web (area weight: 200 g/m$^2$) composed of a polyester fiber (fineness 6 deniers, fiber length: 51 mm) was needle punched (needle depth 10 mm, needle density: 20 strokes/cm$^2$) to give a long sheet (thickness: 3.5 mm, width: 1400 mm, length: 52 m). Double layers (each layer consists of three long sheets), that is, totally six long sheets were overlapped.

First, the three long sheets were overlapped and needle punched (needle density 60 strokes/cm$^2$) to give a sheet (thickness: 6 mm, area weight: 560 g/m$^2$). In the same manner as mentioned above, a sheet (thickness: 7 mm, area weight 620 g/m$^2$) was obtained. Edges of each sheet were cut so that the width of each sheet was 980 mm.

The two sheets were overlapped with dislocating the two sheets so that thin layer portions (each width: 88 mm) at both sides of the overlapped sheets and a central thick layer portion, that is, a thick layer portion (width: 892 mm) at the central portion other than the thin layer portions of the overlapped sheets, were formed.

Next, the central thick layer portion was needle punched (needle density 130 strokes/cm$^2$, needle depth: 14 mm) by means of a needle punching equipment to make entire portions of the sheets one body and to give a lapped sheet.

The central thick layer portion of the lapped sheet was shrunk as the result of being needle punched, and had a thickness of 6.7 to 7.2 mm and a width of 860 mm.

Then, the lapped sheet was passed through a guider having a slit portion 4 as shown in FIG. 3 so that the lapped sheet was transformed into tubular one and that thin layer portions located at both sides of the lapped sheet were overlapped.

When the lapped sheet was passed through the guider having a slit portion, a supporting material was inserted into the tubular lapped sheet.

Two cushioning materials (each width: 100 mm, each thickness: 5 mm) were used as a supporting material.

Then, the portion at which the thin layer portions were overlapped was needle punched with adjusting the needle density to be 130 strokes/cm$^2$ and the needle depth to be 4 mm. In this case, the needle depth means length of the needle projected below the surface of the supporting material.

The tubular felt obtained in this way was a tubular needle punched felt of which seams could not be observed, of which entire circumference had a uniform felt-like surface. Therefore, it can be said that the obtained tubular needle punched felt is completely seamless.

Next, the obtained tubular needle punched felt was used to repair a pipe to be repaired in accordance with the INS method.

After the circumference of the tubular needle punched felt was laminated with a polyurethane film (thickness: 0.3 mm), the tubular needle punched felt was impregnated with an unsaturated polyester which had not yet been cured. Then, the tubular needle punched felt was reversed and the reversed edge thereof was fixed with an edge of a tube to be repaired. After that, the reversing was accelerated by applying water pressure of 0.3 kg/cm$^2$to the outside surface of the reversed tubular needle punched felt, that is, inside surface of the tube to be repaired so that the surface impregnated with the unsaturated polyester of the tubular needle punched felt fitted to the inside surface of the tube to be repaired.

The water was heated to 60° C. for 4 hours to cure the unsaturated polyester initially and further, the water was heated to 90° C. at 2 hours to postcure the unsaturated polyester so that the tubular needle punched felt having a pipe of cured resin was formed at inside surface of the tube to be repaired and that repair of the tube was finished. As the result of the repair, a crack, strain, a gap and the like did not generate in the repaired tube.

As mentioned above, the tubular needle punched felt obtained in accordance with the present invention has excellent merits and is extremely suitable as a tubular felt used in the INS method. However, the uses of the tubular needle punched felt obtained by means of the method of the present invention is not limited to uses in the INS method and the tubular needle punched felt is used as other kinds of tubular felts, for example, a tubular filter medium and the like. The tubular needle punched felt in accordance with the present invention has very wide utility in any uses since the tubular needle punched felt is preferably improved in seamless property thereof.

Having described a specific Example of our bearing, it is believed that modification and variation of our invention are possible in light of the above teachings.

What we claim is:

1. A method for producing a tubular needle punched felt, comprising the steps of:

(a) overlapping not less than two long sheets comprising a web to form thin layer portions at both side edges of the overlapped sheets and a thick layer portion at the central portion of the overlapped sheets by dislocating the sheets in width direction;

(b) needle punching one part or whole of said central thick layer portion of the overlapped sheets to form a lapped sheet;

(c) rolling the lapped sheet and transforming the lapped sheet into a tubular lapped sheet and overlapping said thin layer portions with each other; and (d) needle punching said overlapped thin layer portions to make the thin layer portions one body.

2. The method for producing a tubular needle punched felt of claim 1, including needle punching the overlapped thin layer portions after inserting a supporting material into the tubular lapped sheet, in the step of (d).

3. The method for producing a tubular needle punched felt of claim 1, including needle punching the overlapped thin layer portions after pressing said tubular lapped sheet flat while positioning the overlapped thin layer portions in the needle punching step of (d).

* * * * *